US008076580B2

(12) United States Patent
Kolasa et al.

(10) Patent No.: US 8,076,580 B2
(45) Date of Patent: Dec. 13, 2011

(54) CABLE FOR ENHANCING BIOPOTENTIAL MEASUREMENTS AND METHOD OF ASSEMBLING THE SAME

(75) Inventors: William Kolasa, Belleville, WI (US); Eric Garz, Platteville, WI (US); Daniel J. Lombardi, Verona, WI (US); Geoffrey Reber, Guildford (GB)

(73) Assignee: CareFusion 209, Inc., San Diego, CA (US)

( * ) Notice: Subject to any disclaimer, the term of this patent is extended or adjusted under 35 U.S.C. 154(b) by 185 days.

(21) Appl. No.: 12/480,230

(22) Filed: Jun. 8, 2009

(65) Prior Publication Data

US 2010/0307785 A1 Dec. 9, 2010

(51) Int. Cl.
*H01B 9/02* (2006.01)

(52) U.S. Cl. ..... 174/105 R; 174/113 R

(58) Field of Classification Search ..... 174/105 R, 174/113 R

See application file for complete search history.

(56) References Cited

U.S. PATENT DOCUMENTS

| | | | | |
|---|---|---|---|---|
| 4,461,923 | A | 7/1984 | Bogese, II | |
| 4,890,630 | A | 1/1990 | Kroll et al. | |
| 5,149,915 | A | 9/1992 | Brunker et al. | |
| 5,225,776 | A | 7/1993 | Dobos et al. | |
| 5,392,784 | A | 2/1995 | Gudaitis | |
| 5,427,111 | A | 6/1995 | Traub et al. | |
| 5,491,299 | A | 2/1996 | Naylor et al. | |
| 5,530,203 | A | 6/1996 | Adams et al. | |
| 5,834,699 | A * | 11/1998 | Buck et al. | 174/113 R |
| 5,864,094 | A * | 1/1999 | Griffin | 174/105 R |
| 6,310,286 | B1 | 10/2001 | Troxel et al. | |
| 6,448,500 | B1 | 9/2002 | Hosaka et al. | |
| 6,496,721 | B1 | 12/2002 | Yonce | |
| 6,534,716 | B1 | 3/2003 | Linnell et al. | |
| 6,654,634 | B1 | 11/2003 | Prass | |
| 6,870,109 | B1 | 3/2005 | Villarreal | |
| 7,060,905 | B1 * | 6/2006 | McMahon | 174/110 R |
| 7,260,428 | B2 | 8/2007 | Virtanen | |
| 7,544,894 | B2 * | 6/2009 | Victor | 174/113 R |
| 2005/0203426 | A1 | 9/2005 | Chiang | |
| 2005/0203437 | A1 | 9/2005 | Shambroom et al. | |
| 2005/0267377 | A1 | 12/2005 | Marossero et al. | |
| 2005/0277826 | A1 | 12/2005 | Dunseath, Jr. | |
| 2007/0073266 | A1 | 3/2007 | Chmiel et al. | |
| 2007/0687703 | | 4/2007 | Li et al. | |
| 2008/0255435 | A1 | 10/2008 | Al-Ali et al. | |

FOREIGN PATENT DOCUMENTS

| | | |
|---|---|---|
| WO | WO 03/058646 | 7/2003 |

OTHER PUBLICATIONS

Carobbi, Carlo F. M. et al., "Analysis of the Common-Mode Rejection in the Measurement and Generation of Magnetic Fields Using Loop Probes", IEEE Transactions on Instrumentation and Measurement, vol. 53, No. 2, Apr. 2004, pp. 514-523.

ISA/USA, International Search Report for International Application No. PCT/US2010/37370, 2 pages, Aug. 9, 2010.

* cited by examiner

*Primary Examiner* — Chau Nguyen

(57) ABSTRACT

A cable for enhancing biopotential measurements, including a core, the core including a first conductive line, a first shield that surrounds the first conductive line, and a first insulator that surrounds the first shield. The cable further includes a control section located outside the core, which includes a second conductive line, a second shield that surrounds the conductive line, and a second insulator that surrounds the second shield.

15 Claims, 3 Drawing Sheets

CABLE FOR ENHANCING BIOPOTENTIAL MEASUREMENTS AND METHOD OF ASSEMBLING THE SAME

FIELD OF THE INVENTION

The present invention relates to a cable for enhancing biopotential measurements.

BACKGROUND OF THE INVENTION

A typical biopotential amplifier system includes an amplifier module connected to a patient headbox with a multiconductor cable. Patient electrodes are connected between a patient and the headbox. A typical amplifier has multiple electrode inputs or channels, for example, 8, 16, 32, or 64 channels.

Common mode rejection ratio (CMRR) is one measurement of an amplifier's performance. CMRR indicates the ability of an amplifier to reject common mode interference, typically 50 or 60 Hz, depending upon the power source, e.g., AC power. Common mode voltage can be reduced by driving an inverted version of the patient common-mode signal back into the patient in a negative feedback loop, commonly called the right leg drive (RLD). In this way right leg drive effectively increase the CMRR of a biopotential amplifier system.

FIG. 1 shows a conventional cable 100 for use with a patient headbox for acquiring biopotential measurements having a bundle of wires surrounded by a shield 110, which is itself surrounded by an outer jacket 120. This bundle includes the multiple channel (e.g., patient) electrode wires 130, a reference electrode wire 140, and a right leg drive (RLD) electrode wire 150.

This conventional configuration has drawbacks in that the achievable CMRR is lower then possible. This aforementioned low CMRR results from capacitance, e.g., parasitic capacitance, between the RLD wire 150 and the channel electrode wires 140 due to the close proximity between them in the cable 100. Moreover, this capacitance allows coupling of the RLD signal to the channel wires 130 bypassing the patient. Unbalance of this parasitic capacitance works in conjunction with the patient electrode impedances to reduce the CMRR of the amplifier system. The higher the patient electrode impedance the larger the potential difference between the patient and the channel wires.

Accordingly, there is a need and desire to provide a cable with reduced coupling between the RLD and channel wires for enhancing biopotential measurements and increasing the CMRR of a biopotential amplifier system.

SUMMARY OF THE INVENTION

Embodiments of the present invention advantageously provide a cable for enhancing biopotential measurements.

An embodiment of the invention includes a cable for enhancing biopotential measurements which includes a feedback core including a first conductive line which includes a central feedback line, a first shield that surrounds the central feedback line, and a first insulator that surrounds the first shield. The cable further includes a second conductive line located radially outside the feedback core, a second shield that surrounds the second conductive line and the feedback core, and a second insulator that surrounds the second shield.

Another embodiment includes a cable for enhancing biopotential measurements which includes a feedback core having a first conductive line comprising a central feedback line, a first shield that surrounds the central feedback line, and a first insulator that surrounds the first shield. The cable further includes a control section having a plurality of conductive control lines located radially outside the feedback core, a second shield that surrounds the plurality of conductive control lines and the feedback core, a second insulator that surrounds the second shield, and a sensing section including a plurality of conductive sensing lines radially located outside the control section, a third shield that surrounds the plurality of conductive sensing lines and the control section, and a third insulator that surrounds the third shield.

Another embodiment includes cable for enhancing biopotential measurements which includes a feedback means having a first means for conducting comprising a central feedback means, a first means for shielding that surrounds the central feedback means, and a first means for insulating that surrounds the first means for shielding. The cable further includes a second means for conducting located radially outside the feedback means, a second means for shielding that surrounds the second means for conducting and the feedback means, and a second means for insulating that surrounds the second means for shielding.

A cable for enhancing biopotential measurements, including a core, the core including a first conductive line, a first shield that surrounds the first conductive line, and a first insulator that surrounds the first shield. The cable further includes a control section located outside the core, which includes a second conductive line, a second shield that surrounds the conductive line, and a second insulator that surrounds the second shield.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

The above-mentioned and other features and advantages of this disclosure, and the manner of attaining them, will become more apparent and the disclosure itself will be better understood by reference to the following description of various embodiments of the disclosure taken in conjunction with the accompanying figures, wherein.

DETAILED DESCRIPTION OF THE INVENTION

In the following detailed description, reference is made to the accompanying drawings, which form a part hereof and show by way of illustration specific embodiments in which the invention may be practiced. These embodiments are described in sufficient detail to enable those skilled in the art to practice them, and it is to be understood that other embodiments may be utilized, and that structural, logical, processing, and electrical changes may be made. It should be appreciated that any list of materials or arrangements of elements is for example purposes only and is by no means intended to be exhaustive. The progression of processing steps described is an example; however, the sequence of steps is not limited to that set forth herein and may be changed as is known in the art, with the exception of steps necessarily occurring in a certain order.

Figure 1:
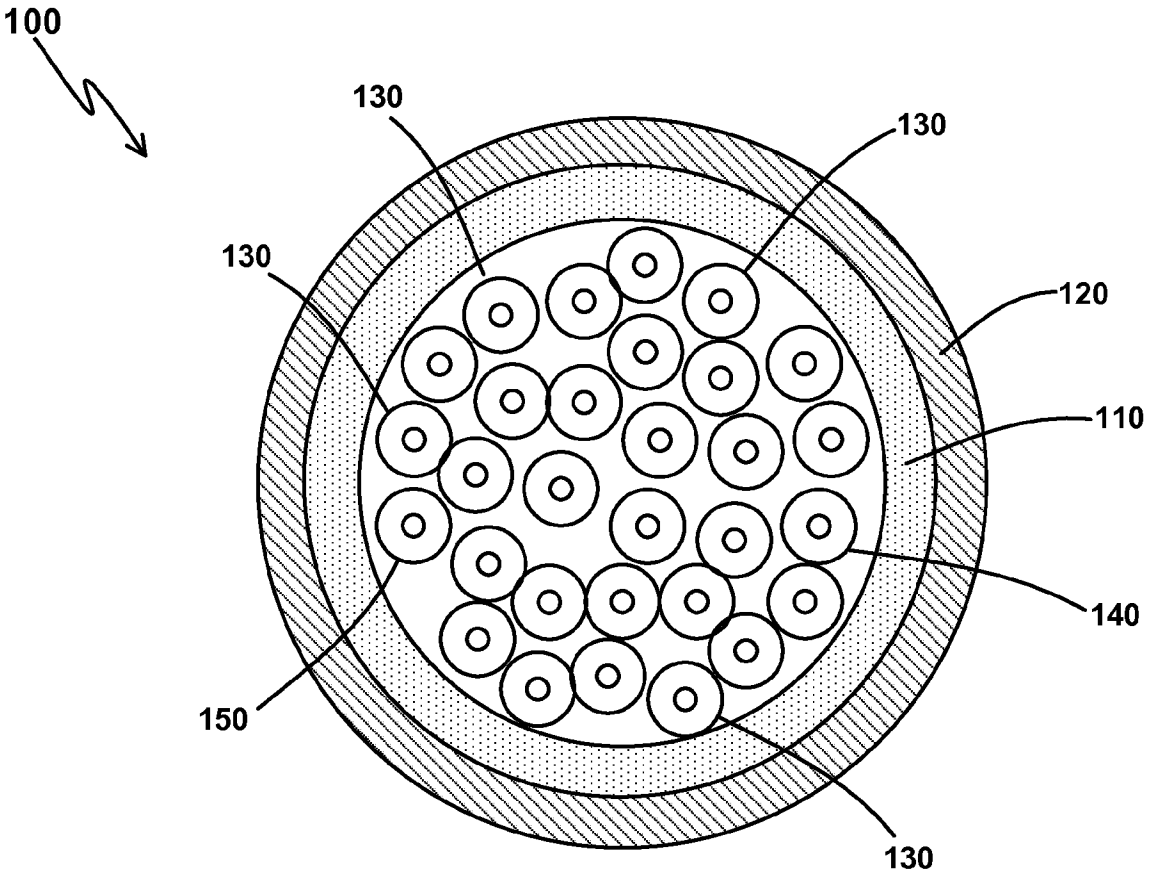
FIG. 1 (Prior Art)
FIG. 1 is a cross-sectional view of a conventional cable.
Figure 2:
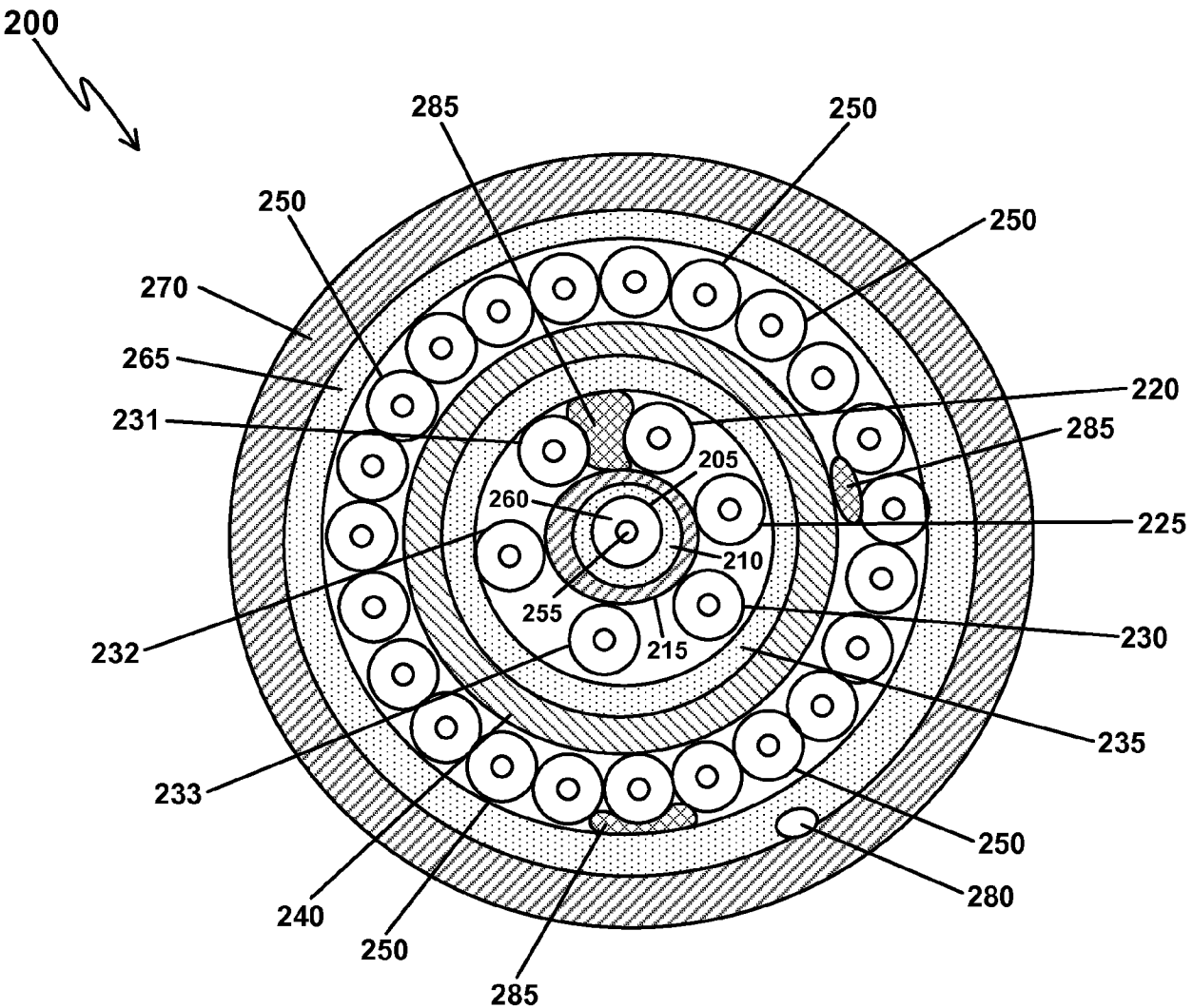
FIG. 2 is a cross-sectional view of a cable in accordance with an embodiment of the present invention.

The invention will now be described with reference to the drawing figures in which like reference numerals refer to like parts throughout. As depicted in FIG. 2, a cable 200 is depicted having a conductive right leg drive (RLD) electrode line 205 at an approximate center surrounded by a right leg drive (RLD) shield 210 and a right leg drive (RLD) insulating jacket 215. The central conductive RLD electrode line 205 functions to provide an inverted version of a common-mode signal back into a patient in a negative feedback loop. In one embodiment, a low power DC voltage line 220, a ground line 225, and digital control lines 230-233 may be surrounded by a middle shield 235 and a middle insulating jacket 240. Conductive patient sensing electrode lines 250 may be arranged around the above-described middle jacket 240. In one embodiment, each conductive line 205, 220, 225, 230-233, and 250 may be constructed from a conducting material 255 surrounded by an insulating sheath 260. The conducting material 255 may be, for example, a single conducting wire or braided strands of a conductor, e.g., copper. An outer shield 265 and an outer insulating jacket 270 may surround the patient electrode lines 250.

The centrally-located RLD line 205 has advantages at least in that the dedicated RLD shield 210 and RLD insulating jacket 215 protect it from parasitic capacitances and interference from the other conductive lines and outside interference sources, thus raising the CMRR of the cable 200. It should be appreciated that the number of digital control lines and patient electrode lines and the order in which the lines are arranged may be adjusted based on the particular application, so long as the RLD line 205 is approximately in the center of the cable 200 surrounded by its dedicated RLD shield 210 and RLD jacket 215. In addition, any or all of the low power DC voltage line 220, ground line 225, and digital control lines 230-233 may be located among the patient sensing electrode lines 250 with no middle shield 235 or middle insulating jacket 240 employed. Either or both of the middle shield 235 and middle jacket 240 may be omitted altogether, depending on the intended use of the cable 200.

Additional shields may be added, for example, to provide more safety protection for lines intended to convey electrical power, e.g., the low power DC voltage line 220. Also, additional material may be added to impart desired properties of mechanical structural strength and/or flexibility to the finished cable assembly. Each shield may be, for example, braided strands of copper, (or other metal), a non-braided spiral winding of copper tape, or a layer of conducting polymer, mylar, aluminum, or copper. The shields may be constructed to have specific dielectric properties, such as to impart a particular desired characteristic impedance to the signals with which they interface. Each jacket 215, 240, 270 may be formed of an insulating material, e.g., PVC or polypropylene.

Embodiments of the present invention may also include an insulation (not shown) outside the outer jacket 270 and a drain line 280 for providing another ground voltage for additional safety and/or to further increase CMRR. An additional shield and jacket (not shown) may be positioned outside the drain line, although the drain line 280 may be placed between the outer shield 265 and the outer jacket 270 or between the outer shield and an additional shield (not shown), with the outer jacket 270 surrounding all of the inner parts. In one embodiment, the drain line 280 is in contact with the additional shield or outer shield 265 so all parts of the shield may be at the same ground voltage. A filler material 285 may be deposited in spaces between any of the materials to displace air and make the cable 200 mechanically more robust and enhance its appearance.

The coupling of the RLD signal in the cable is thus reduced as a result of the above-described cable design and arrangement. Also, an added construction benefit is a closer matching of the capacitance from the patient sensing electrode wires 250 to the middle and outer shield 235, 265 as compared with conventional cables, e.g., cable 100, which further improves the common mode rejection ratio (CMRR). In addition, the DC voltage line 220 may be protected from contact with patient electrode wires by the additional middle shield 235 and a middle jacket 240.

Figure 3:
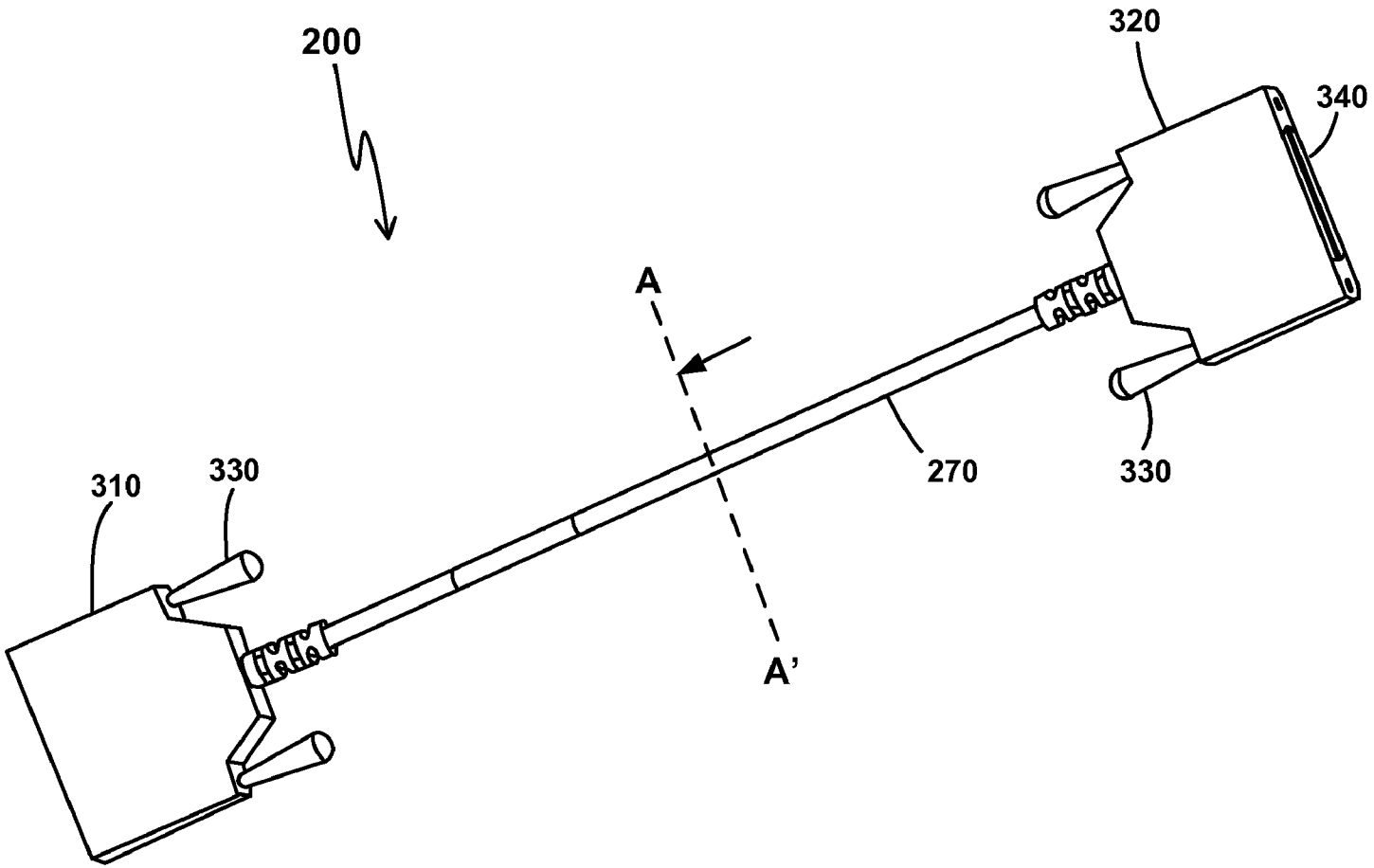
FIG. 3 is a top view of the FIG. 2 cable in accordance with an embodiment of the present invention.

FIG. 3 shows a top view of the cable 200. It should be noted that the FIG. 2 cross section is taken along the line A-A' of FIG. 3. The outer shield 270 is shown as stretched between two connectors 310, 320. The connectors 310, 320 may be configured to connect between a patient headbox (not shown) and an amplifier module (not shown). In the illustrated example, the connectors are both female connectors having attached connecting fastener 330, e.g., a jackscrew, for ensuring a tight and persistent connection. Each connecting fastener 330 may be configured to be removable manually or with a tool, e.g., a screwdriver. The connectors 310, 320 may be custom-made for the application, or may be an off-the-shelf connector. The connectors may have pinouts 340 being respectively connected to each of the above-described conductive lines. It should be appreciated that it is not necessary for each pinout 340 to be connected to a conductive line, and any may be a floating pinouts, as desired.

In one embodiment, a D-subminiature DD-50 connector may be used having fifty (50) connections for up to fifty total conductive lines. For example, there may be one RLD line (e.g., RLD line 205), one power line (e.g., low power DC voltage line 220), one ground line (e.g., ground line 225), four control lines (e.g., digital control lines 230-233), and forty-three (43) sensing line (e.g., patient electrode lines 250). Another embodiment may use a Small Computer System Interface (SCSI) connector. The connectors 310, 320 may be male or female, as appropriate for the intended connection.

Embodiments of the present invention could be manufactured in accordance with the Restriction of the Use of Certain Hazardous Substances in Electrical and Electronic Equipment Regulations of the European Union (RoHS Regulations). Embodiments also include the feedback core being off-center and/or outside the rest of the cables and/or cable package. The central line is not limited to an RLD use or feedback use, but may be used for any purpose that requires increasing CMRR.

The processes and devices in the above description and drawings illustrate examples of only some of the methods and devices that could be used and produced to achieve the objects, features, and advantages of embodiments described herein. Thus, they are not to be seen as limited by the foregoing description of the embodiments, but only limited by the appended claims. Any claim or feature may be combined with any other claim or feature within the scope of the invention.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. A cable for enhancing biopotential measurements, comprising:

a feedback core centered within the cable, the feedback core comprising:

a first conductive line comprising a central feedback line;

a first shield that surrounds the central feedback line; and a first insulator that surrounds the first shield; and a plurality of second conductive lines located radially outside the feedback core;

a second shield that surrounds the second conductive lines and the feedback core;

a second insulator that surrounds the second shield;

a plurality of third conductive lines located radially outside the second insulator;

a third shield that surrounds the third conductive line;

a third insulator that surrounds the third shield, wherein at least a portion of the third insulator and the third shield are in physical contact; and a sole conductive line disposed between and in physical contact with both the third insulator and the third shield, the sole conductive line comprising a ground line.

2. The cable of claim 1, wherein the second conductive lines comprises at least one low power DC voltage line, at least one ground line, and a plurality of digital control lines.

3. The cable of claim 1, further comprising a filler material located adjacent the third conductive line and between the second insulator and the third shield.

4. The cable of claim 1, further comprising a filler material located adjacent the second conductive line and between the feedback core and the second shield.

5. The cable of claim 1, wherein each conductive line comprises a conductive material surrounded by an insulating sheath.

6. The cable of claim 1, further comprising a connector at an end of the cable.

7. The cable of claim 6, wherein the connector comprises a connecting fastener.

8. The cable of claim 6, wherein:

the connector further comprises a respective pinout for each conductive line; and each conductive line is electrically connected to a respective pinout.

9. A cable for enhancing biopotential measurements, comprising:

a feedback core centered within the cable, the feedback core comprising:

a first conductive line comprising a central feedback line;

a first shield that surrounds the central feedback line; and a first insulator that surrounds the first shield; and a control section comprising:

a plurality of conductive control lines located radially outside the feedback core, wherein the plurality of conductive control lines comprises a low power DC voltage line, a ground line, and a plurality of digital control lines;

a second shield that surrounds the plurality of conductive control lines and the feedback core; and a second insulator that surrounds the second shield; and a sensing section comprising:

a plurality of conductive sensing lines radially located outside the control section;

a third shield that surrounds the plurality of conductive sensing lines and the control section; and a third insulator that surrounds the third shield; and a ground section comprising:

a sole conductive line disposed between and in physical contact with both the third insulator and the third shield, wherein the sole conductive line is a ground line and is also electrically coupled with the third shield.

10. The cable of claim 9, wherein the central feedback line, the plurality of conductive control lines, and the plurality of conductive sensing lines each comprises a conductive material surrounded by an insulating sheath.

11. The cable of claim 9, wherein the plurality of digital control lines comprises four digital control lines.

12. The cable of claim 9, wherein the plurality of conductive sensing lines comprises forty-three patient sensing lines.

13. The cable of claim 9, further comprising a filler material located between each of the plurality of conductive control lines.

14. A cable for enhancing biopotential measurements, comprising:

a feedback centered within the cable, the feedback means comprising:

a first means for conducting comprising a central feedback means;

a first means for shielding that surrounds the central feedback means; and a first means for insulating that surrounds the first means for shielding; and a second means for conducting located radially outside the feedback means;

a second means for shielding that surrounds the second means for conducting and the feedback means;

a second means for insulating that surrounds the second means for shielding;

a third means for conducting located radially outside the second means for insulating;

a third means for shielding that surrounds the third means for conducting;

a third means for insulating that surrounds the third means for shielding; and a means for grounding comprising a sole means for conducting disposed between and in physical contact with both the third means for insulating and the third means for shielding.

15. A cable for enhancing biopotential measurements, comprising:

a core, comprising a first conductive line;

a first shield that surrounds the first conductive line; and a first insulator that surrounds the first shield; and a control section located outside the core, comprising:

a second conductive line;

a second shield that surrounds the second conductive line; and a second insulator that surrounds the second shield;

a sensing section outside the control section, comprising:

a plurality of conductive sensing lines radially located outside the control section;

a third shield that surrounds the plurality of conductive sensing lines and the control section; and a third insulator that surrounds the third shield; and a grounding section, comprising:

a sole conductive line disposed between and in physical contact with both the third insulator and the third shield, the sole conductive line comprising a ground line.

* * * * *

UNITED STATES PATENT AND TRADEMARK OFFICE

CERTIFICATE OF CORRECTION

PATENT NO. : 8,076,580 B2
APPLICATION NO. : 12/480230
DATED : December 13, 2011
INVENTOR(S) : Kolasa et al.

It is certified that error appears in the above-identified patent and that said Letters Patent is hereby corrected as shown below:

Title page, item [56] Col. 2, line 16
References Cited: Delete "2007/0687703"
and insert -- 2007/0087703 --

Signed and Sealed this
Twenty-fourth Day of January, 2012

David J. Kappos

David J. Kappos
*Director of the United States Patent and Trademark Office*